United States Patent [19]

Hefti et al.

[11] Patent Number: 4,781,333

[45] **Date of Patent: * Nov. 1, 1988**

[54] ARRANGEMENT FOR HOLDING YARN PACKAGES

[75] Inventors: Walter Hefti, Ettenhausen; Urs Keller, Seuzach; Robert Ammann, Ohringen, all of Switzerland

[73] Assignee: Maschinenfabrik Rieter AG, Winterthur, Switzerland

[ * ] Notice: The portion of the term of this patent subsequent to Jan. 12, 2005 has been disclaimed.

[21] Appl. No.: 78,516

[22] Filed: Jul. 27, 1987

Related U.S. Application Data

[63] Continuation of Ser. No. 843,172, Mar. 24, 1986, Pat. No. 4,718,615.

[30] Foreign Application Priority Data

Apr. 22, 1985 [GB] United Kingdom ..... 85101172

[51] Int. Cl.[4] ..... B65H 54/42; B65H 54/553

[52] U.S. Cl. ..... 242/18 DD; 242/129.51

[58] Field of Search ..... 242/18 DD, 129.51

[56] References Cited

U.S. PATENT DOCUMENTS

| | | | |
|---|---|---|---|
| 4,572,449 | 2/1986 | Naylor | 242/18 DD |
| 4,582,269 | 4/1986 | Robinson et al. | 242/18 DD |
| 4,718,615 | 1/1988 | Hefti et al. | 242/18 DD |

FOREIGN PATENT DOCUMENTS

| | | | |
|---|---|---|---|
| 0126352 | 11/1984 | European Pat. Off. . | |
| 0126373 | 11/1984 | European Pat. Off. . | |
| 0128417 | 12/1984 | European Pat. Off. . | |
| 1560611 | 2/1971 | Fed. Rep. of Germany . | |
| 3421650 | 12/1984 | Fed. Rep. of Germany . | |
| 1055513 | 1/1967 | United Kingdom | 242/18 DD |
| 1344226 | 1/1974 | United Kingdom . | |
| 1349425 | 4/1974 | United Kingdom . | |
| 1407576 | 9/1975 | United Kingdom . | |
| 1588814 | 4/1981 | United Kingdom . | |

*Primary Examiner*—Stanley N. Gilreath
*Attorney, Agent, or Firm*—Michael J. Striker

[57] ABSTRACT

A package holder for use in winding yarn packages comprises at least one arm adapted to support a bobbin tube and pivotable about a first axis as a yarn package is formed on the tube. The arm is also pivotable about a second axis extending transversely to the first axis to make it possible to install or remove the bobbin tubes or packages. A first member is provided which is movable with the arm during the pivoting movement thereof about the first axis. A second member is engaged by the first member and is so mounted that relative movement of the first and second members occurs during the pivoting movement of the arm about the first axis. The zone of contact between the first and second members either includes or passes so close to the second axis that the forces acting between the first and second members have no or only negligible effect on the pivoting about the second axis, or a biassing arrangement for pivoting the arm about the second axis compensates for the effect of any offset of the zone of contact relative to the second axis on such pivoting about the second axis.

10 Claims, 1 Drawing Sheet

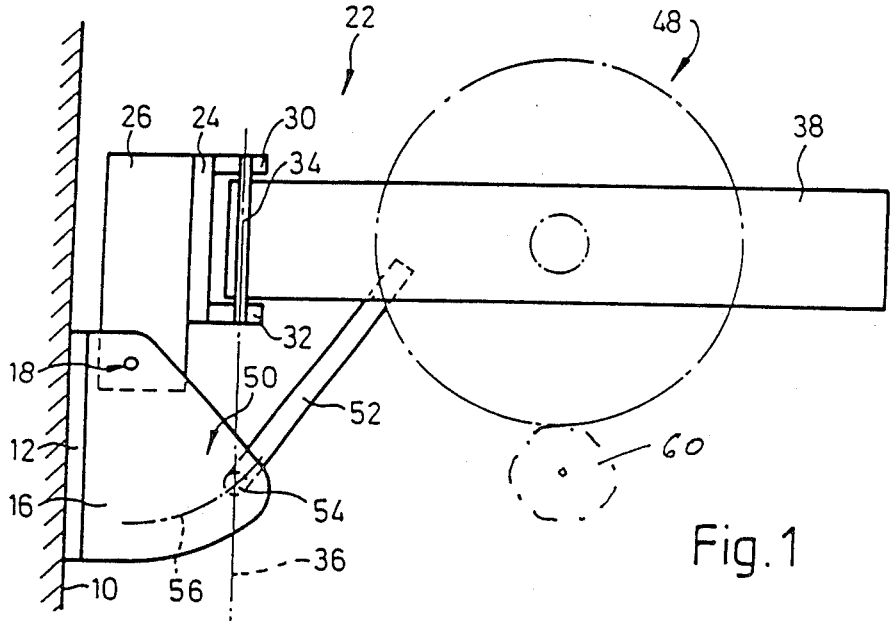
Fig. 1
Fig. 2
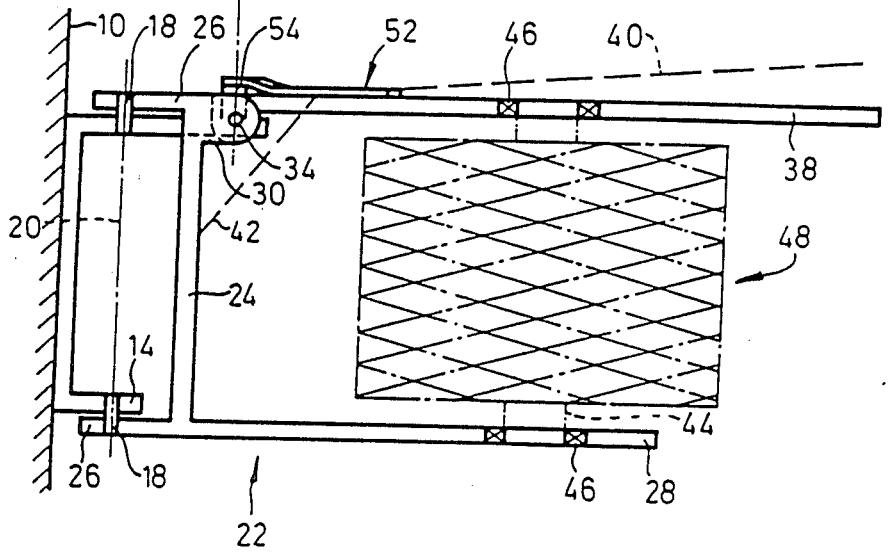

ARRANGEMENT FOR HOLDING YARN PACKAGES

This is a continuation of application Ser. No. 843,172 filed Mar. 24, 1986 now U.S. Pat. No. 4,718,615.

BACKGROUND OF THE INVENTION

The present invention relates to a yarn package winding apparatus in general, and more particularly to an arrangement for holding a bobbin tube while yarn is being wound on such tube during a winding operation.

There are already known many constructions of yarn package winding apparatus which are used, for example, in conjunction with yarn spinning machines, especially rotor, jet, friction and wrap spinning machines, yarn rewinding machines and false twist texturizing machines. The yarn packages formed by such winding apparatus may be cylindrical ("cheeses") or frusto-conical ("cones").

In such apparatus, it is a common practice to use a so-called cradle to support the package during its formation. Such a cradle usually comprises a pair of arms which are adapted to support the respective bobbin tube between them, these arms being jointly pivotable about a common axis which has a fixed position with respect to a machine frame during the package winding operation.

The yarn which is supplied to the winding apparatus is wound onto the bobbin tube supported on the cradle to gradually build up the package on the bobbin tube. This is achieved by causing the bobbin tube to rotate about its longitudinal axis while traversing the yarn to-and-fro across the traverse region which extends in the longitudinal direction of the bobbin tube and is coextensive with the axial length of the package, at a speed which is selected on the basis of the linear delivery speed of the yarn to give a desired pitch to the yarn convolutions of the package. The rotation of the tube and of the package being formed thereon is normally effected by a frictional contact initially of the tube and subsequently of the package being formed thereon with a driven friction roller which is rotatably supported on the machine.

Arrangements of this type are quite well known in the yarn processing field. Examples of such arrangement may be found for instance, in the British Patent Specification No. 1,349,425 (cheeses), published European Patent Application No. 0128417 (cheeses), U.S. Pat. No. 4,415,125 (cones) U.S. Pat. No. 3,139,239 (cones) and British Patent Specification No. 1,344,226 (adjustably settable either for cones or for cheeses). However, many other patents and publications also disclose similar arrangements.

The aforementioned arms of the cradle usually assume a first relative position in which a bobbin tube of an approximately predetermined dimension can be retained between the arms while being free to rotate about its longitudinal axis, and a second position in which the tube is released for removal, usually after a package has been formed thereon, to enable its replacement by a fresh tube in preparation for the next following winding operation. For this purpose, one or both of the arms may be movably mounted on a common support which moves with these arms about the common axis which has been mentioned above. The movement of the respective arm between its first and second relative positions with respect to the other arm may be a pivotal movement about an axis which extends transversely with respect to the common axis. Such an arrangement is also well known in the textile field, as exemplified, for instance, by the British Patent Specification No. 1,588,814.

There is a well-known problem associated with all previous arrangements of this type, namely, the achievement of an adequate positional stability of the package and its support in spite of the occurrence of vibrations which inevitably arise when the drive systems mentioned above are being used. To avoid this problem, it has already been proposed to damp such vibrations, and damping systems involving frictional contact between a part movable with the arms and a part supported on the machine have been disclosed, for instance, in the published German Patent Specifications Nos. 1,560,611 and 3,421,650 in U.S. Pat. No. 3,883,082, in the British Patent Specification No. 1,407,576 and in the U.S. Pat. Nos. 2,605,974 and 3,733,034. However, these arrangements still suffer from certain defects, especially the interference of the vibration damping arrangement with the opening and/or closing movements of the arms.

SUMMARY OF THE INVENTION

Accordingly, it is a general object of the present invention to avoid the disadvantages of the prior art.

More particularly, it is an object of the present invention to provide a yarn package holding arrangement which does not possess the disadvantages of the known arrangements of this kind.

Still another object of the present invention is so to design the arrangement of the type here under consideration as to make it possible for the contact members which provide for the damping of vibrations to remain in contact even during the opening and closing of the cradle.

It is yet another object of the present invention so to arrange the contact members as to assure that their engagement with one another will have only a minimum, if any, effect on the relative movement of the arms of the cradle together and apart.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in an arrangement used in an apparatus for winding yarn packages, for holding bobbin tubes during the winding operation, this arrangement comprising an arm; means on the arm for supporting a portion of the respective bobbin tube; first mounting means for mounting the arm for pivoting about a first axis as a yarn package forms on the respective bobbin tube; second mounting means for mounting the arm for pivoting about a second axis extending transversely to the first axis for installing the bobbin tubes on and removing the packages from the holding arrangement, a first member movable with the arm during the pivoting thereof about the first axis, and a second member engaging the first member with an engagement force at a contact zone which moves about the first axis concurrently with the pivoting of the arm about the first axis and is situated at most so close to the second axis that the engagement force has only a negligible effect on the pivoting of the arm about the second axis. In the alternative, biasing means which is provided for pivoting the arm about the second axis toward its closed position may compensate for the effect of any offset of the contact zone with respect to the second axis.

It is particularly advantageous when the first mounting means includes a cradle including a carrier pivotable about the first axis, the second mounting means, the arm, and another arm mounted on the carrier and adapted to support the respective bobbin tube between itself and the arm. The other arm may be fixed with respect to the carrier. There may advantageously be further provided additional first and second members associated with the other arm in the same manner as the first and second members are with the arm for relative movement during the pivoting of the carrier about the first axis. The apparatus of the present invention may further comprise a frame, and the first axis and the second member are fixed with respect to the frame during the formation of the respective yarn package. The apparatus may also include a friction drive roller for rotating the respective yarn package during the formation thereof. The first member advantageously is a resilient member having a bias to exert the engagement force on the second member.

The improved arrangement as described above is particularly suited for use in conjunction with a travelling doffer device for automatically removing a completed package and replacing it with a fresh tube. A device of this type is disclosed in the published European Patent Application No. 0126352, the disclosure of which is hereby incorporated in its entirety by reference in the present specification. However, the present invention is not limited to such use with a travelling doffer of the type mentioned above, or of any other type.

The novel features which are considered as characteristic of the invention are set forth in particular in the appended claims. The improved yarn package holding arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a side elevational view of a yarn package cradle constructed in accordance with the present invention; and FIG. 2 is a top plan view of the cradle of FIG. 1.

DETAILED DESCRIPTION OF THE PREFERRED EMBODIMENTS

Referring now to the drawing in detail, and first to FIG. 1 thereof, it may be seen that the reference numeral 10 has been used therein to identify a part fixedly mounted on a frame of a machine which forms cylindrical yarn packages when in operation. The particular construction of this machine is not important for understanding the present invention and, therefore, no details of this machine will be presented in this specification. Yet, by way of example only, after the illustrated package cradle has been described its use in a rotor spinning machine in accordance with published European Patent Applications Nos. 0126352 and 0126373 will also be discussed. The full disclosure of the published European Patent Application No. 0126373 is also hereby incorporated by reference in the present application, even though it is only FIG. 10 of that application which has the most immediate relevance in connection with the present developments.

A bracket 12 is secured to the frame part 10 by any suitable means (not shown). The securing means may be such that the bracket 12 is permanently fixed in the predetermined (illustrated) disposition relative to the frame part 10, or that the bracket 12 is movable between the illustrated disposition and one or more other dispositions suitable for winding cones, for example as shown in the British Patent Specification No. 1,344,226. The bracket 12 could also be permanently fixed in another disposition relative to the frame part 12, this other disposition being suitable for the winding of cones with a predetermined cone angle.

The bracket 12 includes two side plates 14 and 16 respectively projecting away ("forwardly") from the frame part 10. Each side plate 14 or 16 supports a respective pivot pin 18, the pins 18 defining a common pivot axis 20 for a package cradle which is generally indicated by the reference numeral 22.

The cradle 22 comprises a yoke 24 having rearwardly projecting side plates 26 which embrace the plates 14 and 16 (see especially FIG. 2) and receive the respective pins 18. These pins 18 support the yoke 24 in a manner enabling pivoting of the cradle 22 about the axis 20 as a yarn package builds up on a bobbin tube carried by the cradle 22 in use, as will be described below.

The yoke 24 furthermore comprises a forwardly projecting arm 28 which is fixed relative to the yoke 24 in alignment with one of the side plates 26 so that the longitudinal direction of the arm 28 extends substantially at right angles to the axis 20 as viewed in the top plan view of FIG. 2. At its opposite side, the yoke 24 comprises respective upper and lower lugs 30 and 32, both of which project forwardly from the yoke 24. Each lug 30 and 32 has a through bore receiving a respective end portion of a pivot pin 34, the pin 34 and the bores together defining a second pivot axis 36 which extends transversely to the axis 20, as may be seen from a comparison of FIGS. 1 and 2 with one another.

A second forwardly projecting arm 38 is mounted on the pin 34 for pivotal movement about the axis 36 between a "closed" position (illustrated in FIG. 2) in which the arm 38 is substantially parallel to the arm 28, and an "open" position in which the forward end of the arm 38 is spaced further from the arm 28 than in the closed position. This latter disposition of the arms 38 and 28 is represented by a dashed line 40 indicating the position of the longitudinal axis of the arm 38 in the open position of the arm 38. The arm 38 is biassed toward its closed position by a tension spring which is diagrammatically indicated by a dashed line 42 and which extends between the arm 38 and the yoke 24.

The arrangement described so far is completely conventional, and it operates in the following manner:

(a) before starting a winding operation, the arm 38 must be moved to its open position against the bias of the spring 42 and a bobbin tube diagrammatically indicated in dash-dotted lines at 44 is inserted between suitable retainers diagrammatically indicated at 46, (b) the cradle 22 is then re-closed so that the retainers 46 grasp and support the inserted tube 44 while leaving it free to rotate about its own longitudinal axis during a subsequent winding operation, (c) the yoke 24 is then pivoted about the axis 20 to bring the inserted tube 44 into a driving contact with a friction drive roller which is indicated in phantom lines in FIG. 1 at 60, and a non-illustrated yarn end is suitably secured to the tube 44 so that it winds thereon to form a package which is diagrammatically indicated at 48. As the outer diameter of the package 48 gradually builds up, the yoke 24 is pivoted back about the axis 20, (d) after the completion of the winding operation, the cradle 22 is reopened, the package 48 is removed together with its tube 44, a fresh tube 44 is inserted and a new winding operation is started. The extension of the arm 38 forwardly beyond the arm 28 shown in FIG. 2 facilitates the opening of the cradle 22 against the bias of the spring 42 when a full package 48 is in place in the cradle 22.

The steps of inserting the bobbin tube 44 and removing the package 48 may be carried out manually or automatically, for example as described in the published European Patent Application No. 0126352 which has been referred to above.

The illustrated cradle 22 is equipped with a frictional damping system to damp vibrations which arise due to the presence of inaccuracies in the mechanical structures during the winding operation, and which could result in a poor package structure if they were allowed to become excessive.

The frictional damping system comprises, as respective components thereof, a segment-shaped forward extension 50 on the side plate 16, which can be seen best in FIG. 1, a leaf spring 52 secured to the arm 38 and extending rearwardly and downwardly to overlap the extension 50, and a contact element 54 extending inwardly from the lower end of the leaf spring 52 to engage the outwardly facing surface of the extension 50. The details of the frictional damping effect itself are not the subject of this invention; as indicated by the references cited in the introductory part of this specification, such effects are already well known to be of use in avoiding winding disturbances. An important feature of the present invention, however, is the arrangement of the zone of contact of the element 54 with the extension 50 relative to the axis 36 of the pin 34.

FIG. 1 illustrates the cradle 22 after the completion of the formation of the respective package 48, that is, when it is ready for the removal of the package 48. The cradle 22 has been pivoted to its uppermost position. It will be seen that the spring 52 still overlaps the extension 50, and that the zone of contact between these parts 50 and 52 includes an imaginary extension of the pivot axis 34. For ease of illustration, the arm 38 has been assumed to be horizontal in this position, the axis 36 is shown to be vertical and the contact zone is situated directly vertically below the pin 34. As will be described later, a practical arrangement may be slightly different, but this makes no difference in principle.

The friction needed for damping the vibrations is produced between the contact element 54 and the plate extension 50 by the pre-tensioning leaf spring 52, which causes a force to act between the element 54 and the extension 50 in a direction normal to the plane of the outwardly facing surface on the extension 50. Due to the arrangement of the zone of contact relative to the axis 36 as presented herein, the line of action of this force intersects the axis 36 or passes very close to it. Consequently, this force exerts little or no turning moment or torque on the arm 38 relative to the axis 36, and thus this force is neutral as far as the opening and closing of the cradle 22 is concerned. This statement holds true for all operating positions of the cradle 22 relative to the axis 18, since the axis 36 passes through the zone of contact in all positions of this zone of contact along a path 56 of its movement which occurs during and corresponds to the swing of the cradle 22 about the axis 18 during the buildup of the respective package 48. This is so inasmuch as the axis 36 is angularly displaced during the swinging or pivotal motion of the cradle 22 about the axis 18 to an extent commensurate with the angular displacement of the zone of contact in its path 56 which is centered on the axis 18.

Since the invention is primarily concerned with the disposition of the zone of contact relative to the pivot axis 36 of the movable arm 38 of the cradle 22, the frictional damping element 54 has been illustrated only in relation to that arm 38. It will be apparent, however, that the plate 14 can also be provided with an extension similar to the extension 50, and the arm 28 can be provided with a leaf spring similar to the spring 52. The arrangement is preferably symmetrical, but this is not essential from the viewpoint of the present invention since the spring acting on the stationary arm 28 has no effect on the opening and closing of the cradle 22. Arrangements are, however, known in which both arms 28 and 38 are movable relative to the support yoke 24 for opening and closing of the cradle 22. In such cases the zone of contact of the second damping element 54 with its contact surface on the frame should also pass through or close to the axis of pivoting of the corresponding arm 28 during the opening and closing of the cradle 22.

The invention is not limited to the illustrated form of the cradle 22 or to the illustrated damping elements. The same effect could be achieved by extending a rigid bar from the arm 38 along the line of action of the leaf spring 52 and by providing a contact button at the free end of this rigid bar. The force normal to the contact surface is then produced, for example, by a compression spring. As an alternative, a shorter leaf spring could be mounted on a rigid projection provided on the arm 38.

The illustrated arrangement, in which the axis 36 lies in the plane of the outwardly facing surface of the extension 50 and intersects the zone of contact with the element 54, however, is the preferred one. Yet, substantially the same effect could be achieved if there were only minor deviations from this arrangement. As the deviations become greater, the force normal to the extension 50 will begin to exert an opening or closing moment or torque on the cradle 22. When this occurs, this effect can be compensated for by adjusting the bias applied by the spring diagrammatically indicated at 42, or by any other cradle closing mechanism which may be used.

If the zone of contact were shifted forwardly of the axis 36, then the leaf spring 52 would tend to open the cradle 22 and the spring 42 would have to be made stronger. It is highly unlikely that this would be desirable. On the other hand, if the zone of contact were shifted rearwardly of the axis 36, then the leaf spring 52 would tend to close the cradle 22 and the spring 42 could be made weaker, possibly even to the extent that the spring 42 could be eliminated altogether.

As already mentioned before, however, the preferred arrangement is the one which is illustrated in the drawing and in which it is possible to choose the closing forces and the damping forces substantially independently of each other.

As indicated previously, the illustrated cradle 22 can be used in a rotor spinning machine which is equipped with an associated travelling service device, sometimes referred to as a tender, as disclosed in the published European Patent Applications Nos. 0126353 and 0126373. For this purpose, the disposition of the arms 28 and 38 relative to the horizontal and the extent of the swing of the cradle 22 about the axis 20 must be adapted to the design of such a machine and such a tender, and the support 10 must be arranged to permit the respective full package 48 to be ejected rearwardly towards a receiving conveyor running along the center line of the machine. The "symmetrically damped" cradle arrangement which has been briefly discussed above and in which a leaf spring acts on each of the arms 28 and 38 is preferably used under these circumstances. In all other respects, the illustrated cradle 22 is ready for an immediate application to the system described in the earlier applications mentioned above.

It will be understood that each of the elements described above, or two or more together, may also find a useful application in other types of arrangements differing from the type described above.

While the invention has been illustrated and described as embodied in a package holding arrangement for use in winding cylindrical yarn packages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. In an apparatus for winding yarn packages, an arrangement for holding bobbin tubes during the winding operation, comprising means for supporting a bobbin tube, said bobbin tube supporting means including at least one arm; first mounting means for mounting said at least one arm for pivoting about a first axis as a yarn package forms on the respective bobbin tube; second mounting means for mounting said at least one arm for pivoting about a second axis extending transversely to said first axis for installing the bobbin tubes on and removing the packages from the holding arrangement, a first member movable with said at least one arm during a pivoting thereof about said first axis and also about said second axis, and a second member engaging said first member during the pivoting thereof about said first axis as well as about said second axis with an engagement force at a contact zone which moves about said first axis concurrently with the pivoting of said at least one arm about said first axis and is situated at most so close to said second axis that said engagement force has only a negligible effect on the pivoting of said at least one arm about said second axis.

2. The apparatus as defined in claim 1, wherein said first mounting means includes a carrier pivotable about said first axis, said second mounting means and said at least one arm being mounted on said carrier.

3. The apparatus as defined in claim 2, further comprising a frame; and wherein said first axis and said second member are fixed with respect to said frame during the formation of the respective yarn package.

4. The apparatus as defined in claim 2, and further comprising a friction drive roll for rotating the respective yarn package during the formation thereof.

5. The apparatus as defined in claim 2, wherein said first member is a resilient member having a bias to exert said engagement force on said second member.

6. In an apparatus for winding yarn packages, an arrangement for holding bobbin tubes during the winding operation, comprising means for supporting a bobbin tube, said bobbin tube supporting means including at least one arm; first mounting means for mounting said at least one arm for pivoting about a first axis as a yarn package forms on the respective bobbin tube second mounting means for mounting said at least one arm for pivoting about a second axis extending transversely to said first axis for installing the bobbin tubes on and removing the packages from the holding arrangement; a first member movable with said at least one arm during a pivoting thereof about said first axis; a second member juxtaposed with said first member at a contact zone which moves about said first axis concurrently with the pivoting of said at least one arm about said first axis and is situated at an offset from said second axis; means for urging said first and second members with engagement force into contact with one another at said contact zone during the pivoting thereof about said first axis as well as about said second axis; and biasing means for biasing said at least one arm toward a predetermined angular position about said second axis and operative for compensating for the torque about said second axis exerted on said at least one arm by said engagement force.

7. The apparatus as defined in claim 6, wherein said first mounting means includes a carrier pivotable about said first axis, said second mounting means and said at least one arm being mounted on said carrier.

8. The apparatus as defined in claim 7, further comprising a frame; and wherein said first axis and said second member are fixed with respect to said frame during the formation of the respective yarn package.

9. The apparatus as defined in claim 7, and further comprising a friction drive roll for rotating the respective yarn package during the formation thereof.

10. The apparatus as defined in claim 7, wherein said first member is a resilient member having a bias to exert said engagement force on said second member.

* * * * *